US007789728B2

(12) United States Patent
Friedman et al.

(10) Patent No.: US 7,789,728 B2
(45) Date of Patent: Sep. 7, 2010

(54) ADAPTER FOR MOTORIZING A NON-MOTORIZED TOY VEHICLE

(75) Inventors: Jack Friedman, Thousand Oaks, CA (US); Stephen Berman, Malibu, CA (US); Jack McGrath, Malibu, CA (US)

(73) Assignee: JAKKS Pacific, Inc., Malibu, CA (US)

( * ) Notice: Subject to any disclaimer, the term of this patent is extended or adjusted under 35 U.S.C. 154(b) by 770 days.

(21) Appl. No.: 11/513,507

(22) Filed: Aug. 30, 2006

(65) Prior Publication Data

US 2007/0060019 A1 Mar. 15, 2007

Related U.S. Application Data

(60) Provisional application No. 60/713,306, filed on Aug. 31, 2005.

(51) Int. Cl.
*A63H 29/20* (2006.01)
*A63H 29/00* (2006.01)

(52) U.S. Cl. ..... 446/429; 446/217; 446/430

(58) Field of Classification Search ..... 446/160–165, 446/457, 456, 454, 460, 465, 217, 429, 430
See application file for complete search history.

(56) References Cited

U.S. PATENT DOCUMENTS

| | | | | |
|---|---|---|---|---|
| 3,803,756 | A * | 4/1974 | Strongin | 446/429 |
| 3,895,458 | A * | 7/1975 | Lemelson | 446/429 |
| 4,732,569 | A * | 3/1988 | Hippely et al. | 446/430 |
| 5,158,495 | A | 10/1992 | Yonezawa | |
| 5,499,940 | A * | 3/1996 | Johnson et al. | 446/180 |
| 5,823,848 | A * | 10/1998 | Cummings | 446/429 |
| 5,846,120 | A * | 12/1998 | Barton, Jr. | 446/434 |
| 6,183,333 | B1 * | 2/2001 | Hall | 446/154 |
| 7,044,826 | B2 * | 5/2006 | Edwards | 446/428 |
| 7,488,233 | B2 * | 2/2009 | Olney | 446/462 |
| 2005/0266769 | A1 * | 12/2005 | Edwards | 446/454 |
| 2006/0154563 | A1 | 7/2006 | Saeki | |
| 2008/0096460 | A1 * | 4/2008 | Sandoval et al. | 446/279 |

FOREIGN PATENT DOCUMENTS

| | | |
|---|---|---|
| GB | 2 290 241 | 12/1995 |
| WO | WO 98/06471 | 2/1998 |

* cited by examiner

*Primary Examiner*—Nini Legesse
(74) *Attorney, Agent, or Firm*—Tope-McKay & Associates

(57) ABSTRACT

Described is a toy vehicle adapter that includes at least one motorized wheel for attaching with a non-motorized toy vehicle. The adapter includes a housing with an attachment apparatus that is formed to attach with the toy vehicle. A receiver is included that is capable of receiving a wireless signal to actuate the motor. When connected with the toy vehicle, the motor may be activated to engage with the wheel and thereby force the toy vehicle across a surface. Thus, the adapter is formed to convert a non-motorized toy vehicle into a remotely-controlled motorized vehicle.

23 Claims, 15 Drawing Sheets

100

ADAPTER FOR MOTORIZING A NON-MOTORIZED TOY VEHICLE

PRIORITY CLAIM

The present application is a non-provisional application, claiming the benefit of priority of U.S. Provisional Application No. 60/713,306, filed on Aug. 31, 2005 entitled, "An Adapter for Motorizing a Non-motorized Toy Vehicle."

BACKGROUND OF THE INVENTION (1) Field of Invention

The present invention relates to a toy vehicle adapter and, more particularly, to an adapter having a remotely-controlled motorized wheel for attaching with a non-motorized toy vehicle which thereby converts the toy vehicle into a remote-controlled toy vehicle.

(2) Description of Related Art

Toy vehicles have long been known in the art. Toy vehicles traditionally include four wheels and are powered through a variety of mechanisms and techniques. For example, some motor-less toy vehicles are simply powered by a user as the user rolls the toy vehicle across a surface. Other toy vehicles are motorized, having a built-in motor for rotating the vehicle's wheels.

While both motorized and non-motorized toy vehicles exist, nothing heretofore devised enables a user to convert a non-motorized toy vehicle into a motorized one. Thus, a continuing need exists for an adapter that allows a user to convert non-motorized toy vehicles into motorized toy vehicles.

SUMMARY OF INVENTION

The present invention relates to an adapter for motorizing a non-motorized toy vehicle. The adapter comprises a housing and an an attachment apparatus connected with the housing. The housing and attachment apparatus are formed to attach with the toy vehicle. A driving apparatus is connected with the housing that is capable of providing a driving force to a propelling apparatus. A propelling apparatus is drivably connected with the driving apparatus. When the adapter is connected with a toy vehicle, the driving apparatus may be activated to engage with the propelling apparatus, thereby causing the propelling apparatus to force the toy vehicle across a surface.

In another aspect, a receiver is connected with the housing. Additionally, the receiver is electrically connected with the driving apparatus and is configured to receive a wireless signal from a signal transmitter. Thus, attaching the adapter with a non-motorized toy vehicle converts the toy vehicle into a wirelessly controlled toy vehicle.

In yet another aspect, the housing and attachment apparatus are formed to detachably attach with the toy vehicle.

In another aspect, the housing is formed to include a cavity. The cavity is formed to accommodate at least a portion of a toy vehicle therein, such as a rear portion of a 1:64 scale die-cast toy vehicle.

Additionally, the driving apparatus comprises a first motor and a second motor, and the propelling apparatus comprises a first wheel and a second wheel. The first motor is drivably coupled with the first wheel and the second motor is drivably coupled with the second wheel. Further, the receiver is connected with both the first and second motors such that a control signal from a signal transmitter provides for independent control of each of the first and second motors and thereby allows for independent control of the first and second wheels.

In another aspect, the present invention further comprises a drive system connecting the driving apparatus with the propelling apparatus to drive the propelling apparatus.

Additionally, the attachment apparatus comprises a pair of spring-loaded pins, each of which is positioned within the cavity to allow for attachment of the toy vehicle therebetween.

In another aspect, an adapter power source is included for powering the driving apparatus. The adapter power source is any suitable power source, such as a capacitor.

In another aspect, an adapter coupler is attached with the housing. The adapter coupler is electrically connected with the adapter power source and is formed to detachably attach with a charging mechanism.

Additionally, a controller is included that possesses a signal transmitter for transmitting a signal to the receiver. The controller further comprises a controller coupler that is formed to electrically connect with the adapter coupler, such that when connected, the controller power source is electrically connected with the adapter power source. Thus, the controller can be used for charging the adapter power source.

In another aspect, the attachment apparatus is a clip that includes a spring mechanism, such that the clip can be opened to accommodate and attach with toy vehicles of varying sizes.

Additionally, a turning motor can be connected with the housing. In this aspect, the turning motor is configured to turn the wheel, such that a user may steer the adapter when in motion by using a transmitter to turn the wheel.

Finally, as can be appreciated by one of skill in the art, the present invention also comprises a method for forming and using the adapter described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to a toy vehicle adapter and, more particularly, to an adapter having a remotely-controlled motorized wheel for attaching with a non-motorized toy vehicle. Attaching the adapter with the toy vehicle effectively converts the toy vehicle into a remotely-controlled vehicle. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels "left," "right," "front," "back," "top," "bottom," "forward," "reverse," "clockwise" and "counter clockwise" have been used for convenience only and are not intended to imply any particular fixed direction. Instead, they are used to reflect relative locations and/or directions between various portions of an object.

(1) Description

Figure 1:
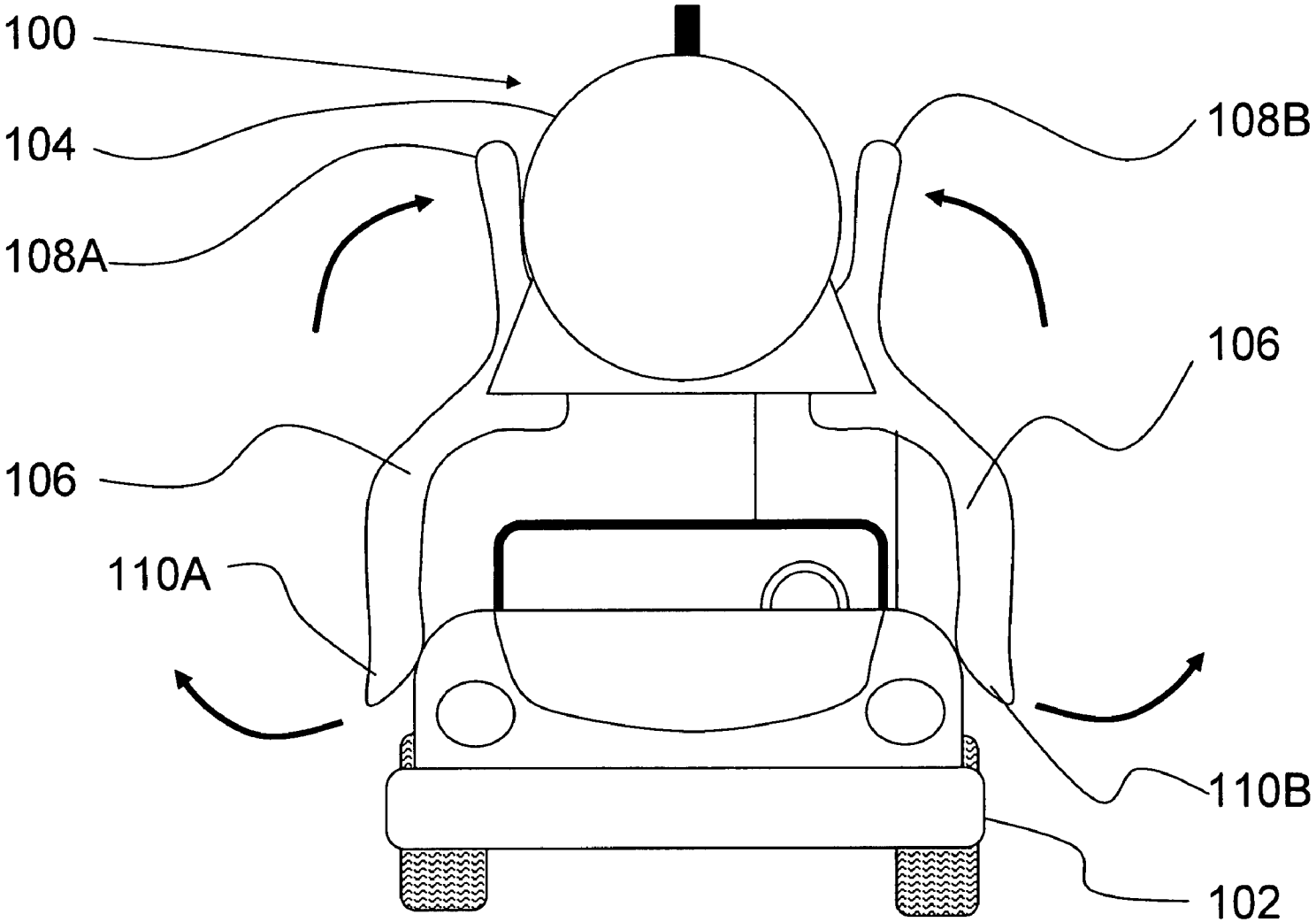
FIG. 1 is a front-view illustration of an adapter according to the present invention, attached with an exemplary toy vehicle.

As shown in FIG. 1, the present invention relates to an adapter 100 for motorizing a non-motorized toy vehicle 102. The toy vehicle 102 is any suitable toy vehicle 102 for attaching with the adapter 100, a non-limiting example of which includes a 1:64 scale, die-cast toy vehicle, such as a 1:64 scale, die-cast toy car.

The adapter 100 includes a housing 104 with an attachment apparatus 106 connected with the housing 104. The housing 104 is formed of any suitably durable material, non-limiting examples of which include foam, plastic, and metal. The attachment apparatus 106 is any suitable mechanism or device for attaching the adapter 100 with a toy vehicle 102, non-limiting examples of which include a clip with a spring mechanism (shown in FIG. 1), and a spring-loaded pin (shown in FIG. 6). A non-limiting example of such a clip includes top portions 108A and 108B and bottom portions 110A and 110B, configured such that by squeezing the top portions 108A and 108*b* together, the bottom portions 110A and 110B are separated from each other to accommodate and attach with toy vehicles 102 of varying sizes. The spring mechanism is attached with the attachment apparatus 106 such that the two corresponding bottom portions 110 are forced toward each other to retain a toy vehicle 102 therebetween. As can be appreciated by one skilled in the art, although the attachment apparatus 106 is described above as a clip mechanism, the attachment apparatus 106 is not intended to be limited thereto and may be formed in any suitable manner for attaching with the toy vehicle 102. Other non-limiting examples included a hook and loop, suction cups, and a spring-loaded pin (as described in further detail below).

Figure 2:
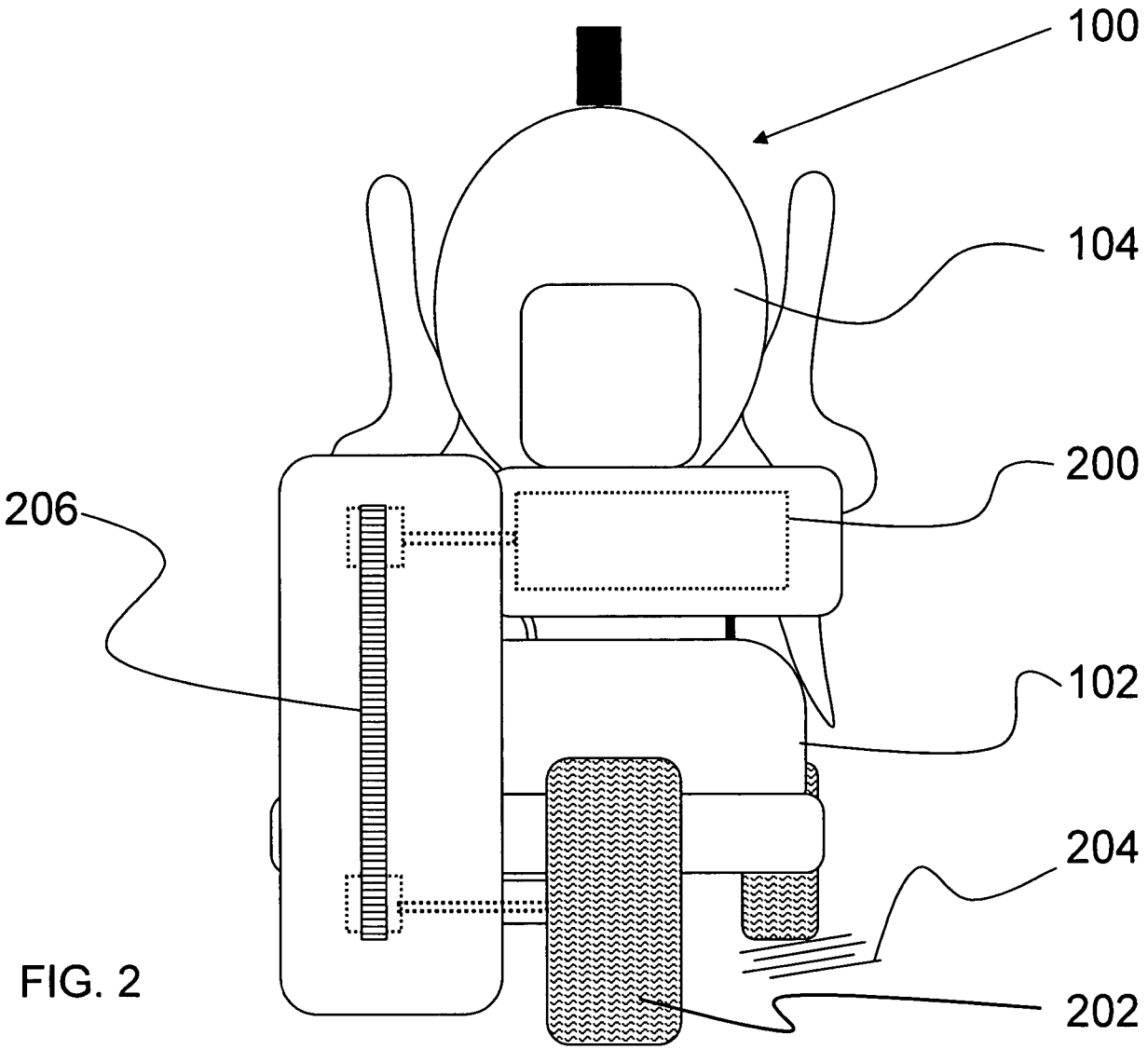
FIG. 2 is a rear-view illustration of an adapter according to the present invention, attached with an exemplary toy vehicle.

FIG. 2 is a rear-view illustration of the adapter 100. As shown in FIG. 2, a driving apparatus 200 is attached with the housing 104. The driving apparatus 200 can be attached externally to the housing 104 or encased within the housing 104. The driving apparatus 200 is any suitable mechanism or device for driving a propelling apparatus 202, a non-limiting example of which includes a wheel.

The propelling apparatus 202 is connected with the driving apparatus 200. The propelling apparatus 202 is any suitable mechanism or device for propelling the adapter 100 and an attached toy vehicle 102 across a surface 204. For example, the propelling apparatus 202 is a wheel, such that when attached with a wheeled toy vehicle, the driving apparatus 200 may be activated to engage with the propelling apparatus 202, causing the propelling apparatus 202 to spin and force the toy vehicle 102 across the surface 204.

As can be appreciated by one skilled in the art, the driving apparatus 200 is connected with the propelling apparatus 202 in any suitable manner to actuate the propelling apparatus 202. For example, the driving apparatus 200 may be directly connected with the propelling apparatus 202. As another non-limiting example, a drive system 206 connects the driving apparatus 200 with the propelling apparatus 202. The drive system 206 is any mechanism or device for operably connecting the driving apparatus 200 with the propelling apparatus 202 to drive the propelling apparatus 202, non-limiting examples of which include gears and/or a belt drive system.

As yet another non-limiting example, the driving apparatus 200 can be magnetically coupled with the propelling apparatus 202 to form a non-physical coupling.

In another aspect, the propelling apparatus 202 is a water propeller (not shown). In this aspect, when the adapter 100 is attached with an aqueous toy vehicle 102 (such as a toy boat), and when the toy vehicle 102 is placed in water, the water propeller operates to propel the toy vehicle 102 across the water.

Figure 3:
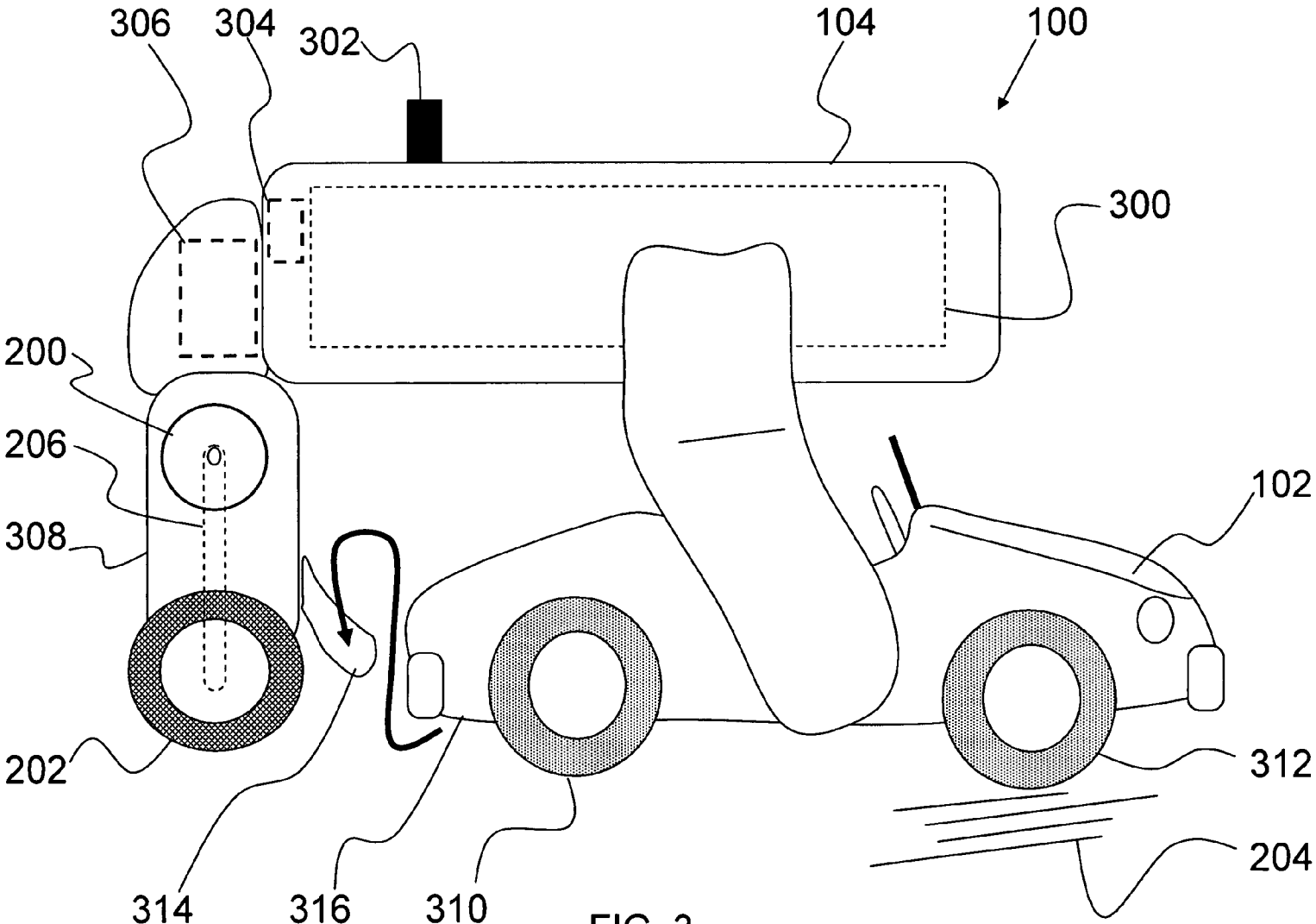
FIG. 3 is a right, side-view illustration of an adapter according to the present invention, attached with an exemplary toy vehicle.

As shown in FIG. 3, a power source compartment 300 is included within the housing 104. The power source compartment 300 is formed to contain a power source (such as a battery or a capacitor) within the power source compartment 300 to power the driving apparatus 200. A power switch 302 is attached with the adapter 100 and is formed to electrically connect an attached power source with the driving apparatus 200.

Additionally, the adapter 100 is formed such that it can be remotely controlled using wired or wireless technology. When wireless, a receiver 304 is attached with the housing 104 that is configured to receive a signal from a signal transmitter (shown in FIG. 15) and control the adapter 100 accordingly.

The adapter 100 is further formed to allow a user to steer the adapter 100 when in operation. In one aspect, a turning motor 306 is connected with the housing 104. The turning motor 306 is configured to turn the propelling apparatus 202. By allowing a user to turn the propelling apparatus 202, a user may steer the adapter 100 and attached toy vehicle 102 when the adapter 100 is in motion.

As can be appreciated by one skilled in the art, there are numerous techniques in which to use a turning motor 306 to turn the propelling apparatus 202. Thus, the following description is for illustrative purposes only and is not intended to be limiting. For example, both the driving apparatus 200 and the propelling apparatus 202 are connected with a portion of the housing 104 that houses the drive system 206 (i.e., drive system housing 308). The drive system housing 308 is rotatably attached with another portion of the housing 104 so that it is capable of turning the propelling apparatus. The turning motor 306 is encased within the housing 102 and is attached with the drive system housing 308 in such a way that activation of the turning motor 306 turns the drive system housing 308 and thus turns the direction of the propelling apparatus 202.

In another aspect, the adapter 100 is formed such that when it is attached with the toy vehicle 102, the rear wheels 310 of the toy vehicle 102 are lifted from the surface 204. In this aspect, when the rear wheels 310 are lifted from the surface 204, the propelling apparatus 202 and the front wheels 312 of the toy vehicle 102 rest upon the surface 204, forming at least a three point connection with the surface 204. As can be appreciated by one skilled in the art, there are numerous adapter 100 configurations for attaching the adapter 100 with the toy vehicle 102 such that it lift the toy vehicle's 102 rear wheels 310. As a non-limiting example, a lift tab 314 is connected with and extends from the drive system housing 308. The lift tab 314 is formed to be placed under a rear portion 316 of the toy vehicle 102 to raise the toy vehicle's 102 rear portion 316, and thus the rear wheels 310. Lifting the rear wheels 310 results in less friction points between toy vehicle 102 and the surface 204 so that the adapter 100 with attached toy vehicle 102 can turn more easily.

Figure 4:
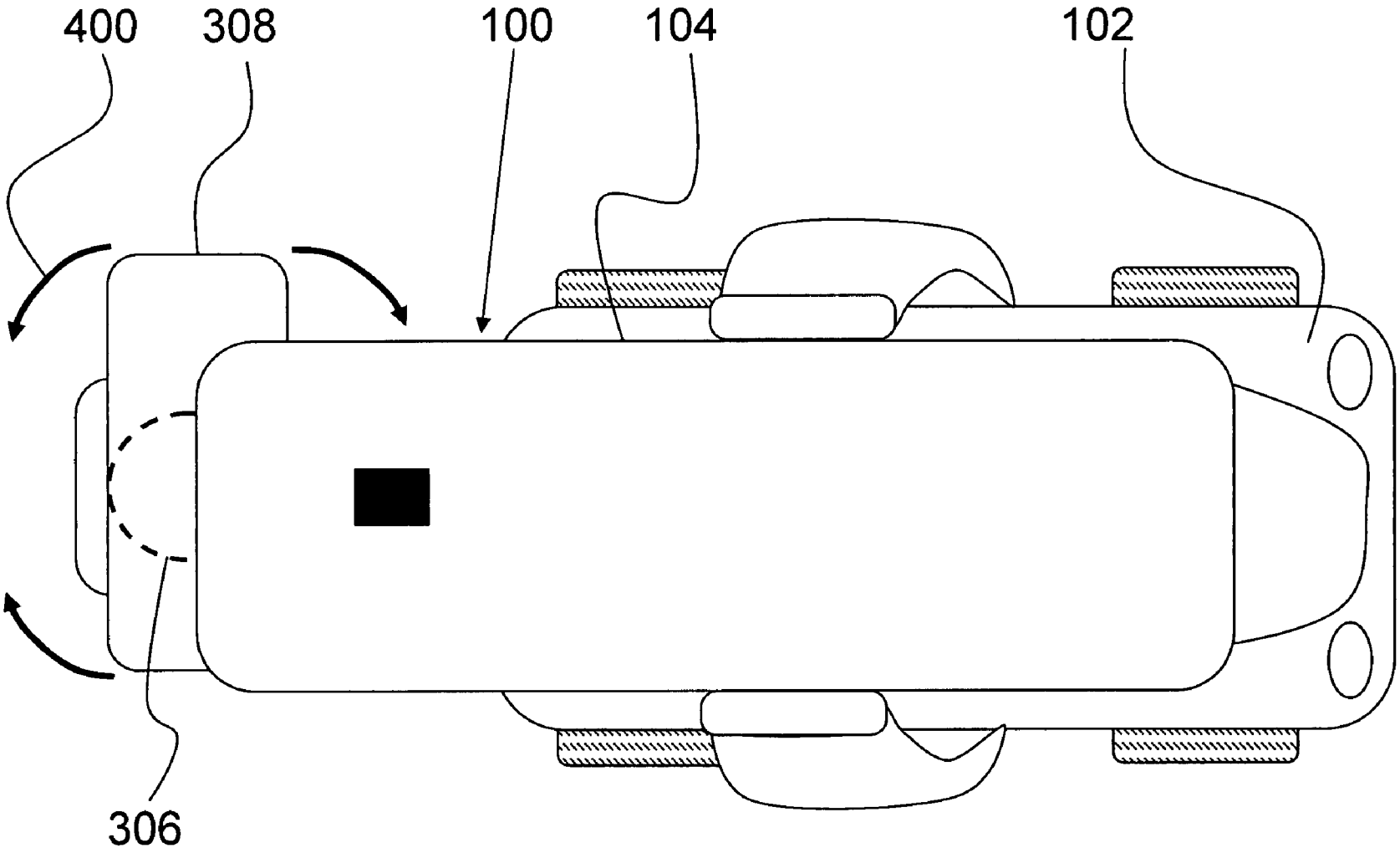
FIG. 4 is a top-view illustration of an adapter according to the present invention, attached with an exemplary toy vehicle.

FIG. 4 illustrates a top-view of the adapter 100 attached with an exemplary toy vehicle 102. As can be seen in FIG. 4, the drive system housing 308 is rotatably connected with another portion of the housing 104 to allow for rotation 400 therebetween. By controlling the turning motor 306, a user may rotate 400 the drive system housing 308 to turn the propelling apparatus and thereby steer the adapter 100 with attached toy vehicle 102.

Figure 5:
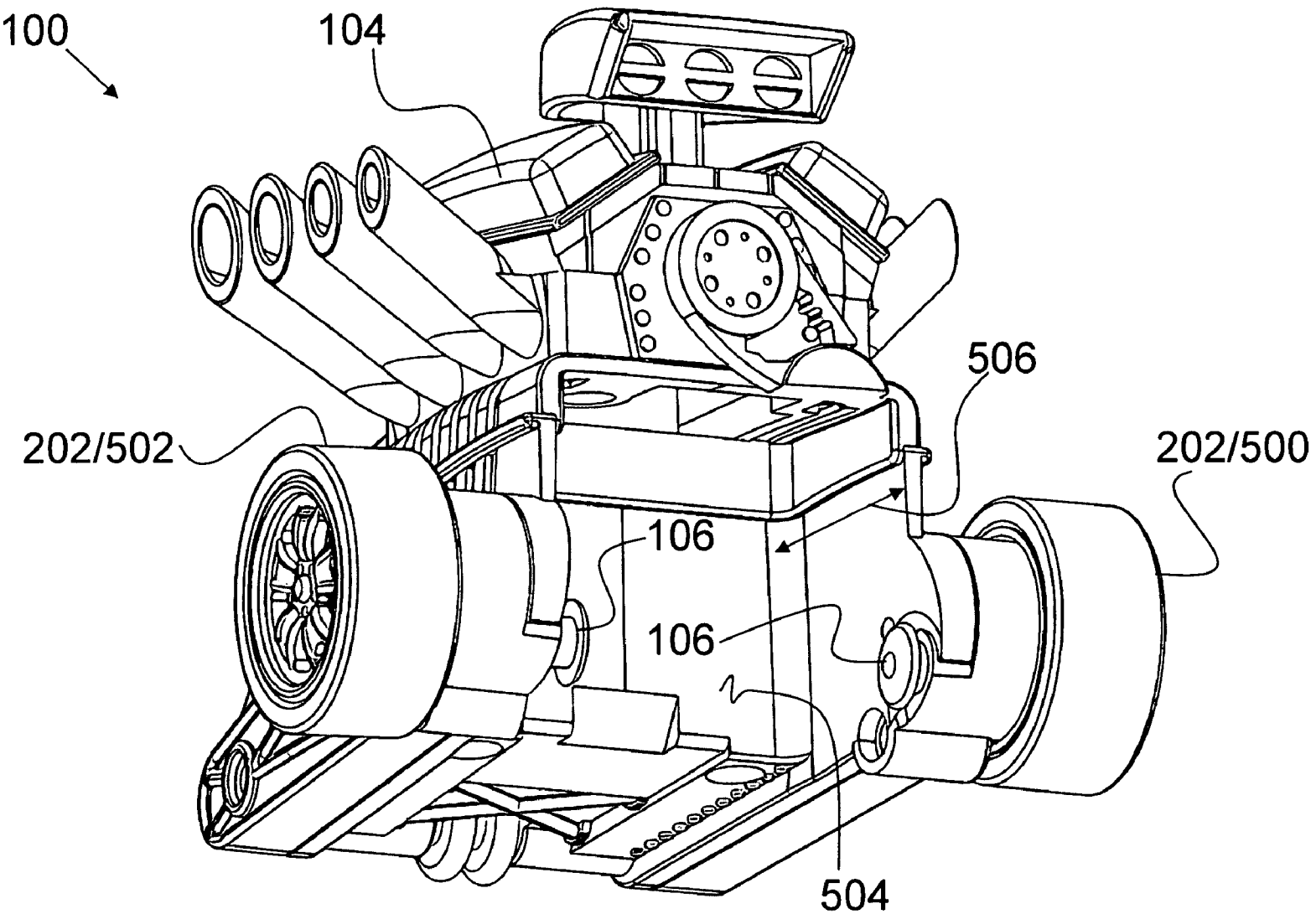
FIG. 5 is a front, perspective-view illustration of an adapter according to the present invention.

FIG. 5 illustrates a front, perspective-view of an adapter 100 where the propelling apparatus 202 includes multiple wheels. More specifically, the propelling apparatus includes a first wheel 500 and a second wheel 502. In this aspect, the driving apparatus (not shown), also includes multiple components, such as a first motor and a second motor. The first motor is drivably coupled with the first wheel 500 while the second motor is drivably coupled with the second wheel 502.

The first and second motors are selected from any suitable type of motor for turning a wheel, a non-limiting example of which includes an electric motor with a rotatable drive shaft. In one aspect, the motors are electric motors connected with a power source, such as a capacitor.

As described above, a receiver is included for receiving control signals from a remotely controlled signal transmitter. The receiver is connected with the housing 104 in any suitable location, but is desirably encased within the housing 104. The receiver is connected with both the first and second motors, such that a control signal from the remotely controlled signal transmitter provides for independent control of each of the first and second motors and their respective first 500 and second 502 wheels. In other words, each of the motors is independently controlled such that a user can control and steer the adapter 100 by selectively actuating one or both of the motors.

In another aspect, a cavity 504 is formed within the housing 104 to allow for placement of a toy vehicle. The cavity 504 includes a depth 506 that is sufficient for the placement of at least a portion of the toy vehicle. For example, the rear portion of a 1:64 die-cast toy car can be placed within the cavity 504. In this aspect, the attachment apparatus 106 is formed to lock the toy vehicle in place after it is positioned within the cavity 504. For example, the attachment apparatus 106 can include multiple spring-loaded pins, where a single spring-loaded pin is attached with the housing 104 on each side of the cavity 504, thereby allow for placement of the toy vehicle therebetween. In this aspect, the attachment apparatus 106 can be formed such that each pin aligns and connects with the rear tires on a toy vehicle. When the toy vehicle is attached with the adapter 100, a user may remotely control the non-motorized toy vehicle.

Figure 6:
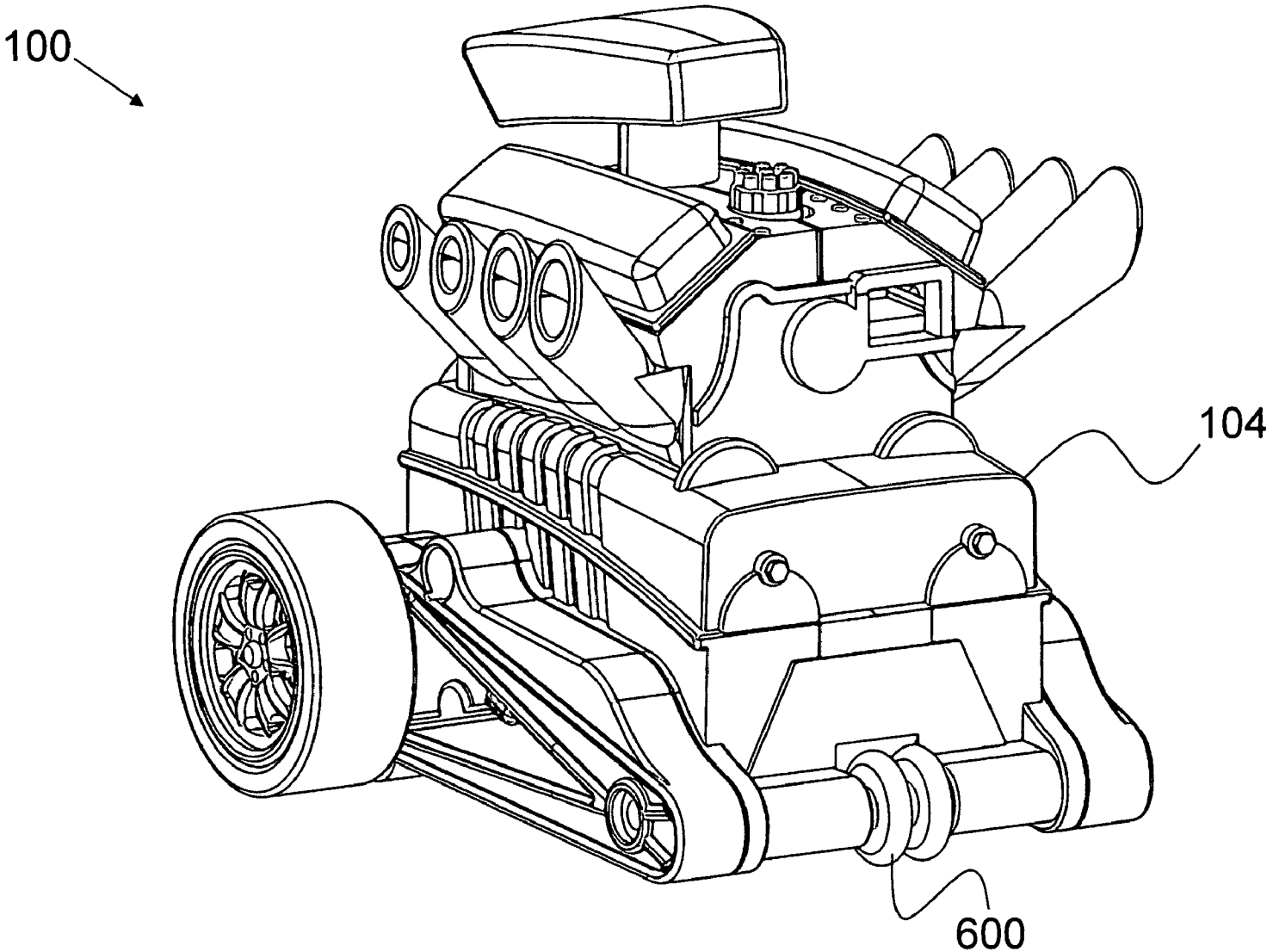
FIG. 6 is a rear, perspective-view illustration of an adapter according to the present invention.

FIG. 6 illustrates a rear, perspective-view of the adapter 100. As shown, a stabilization apparatus 600 is attached with the housing 104 to reduce frictional drag of the housing 104 when moved across a surface. Although illustrated as having two wheels, the stabilization apparatus 600 is any suitable mechanism or device for reducing drag, non-limiting examples of which include a wheel and roller ball.

Figure 7:
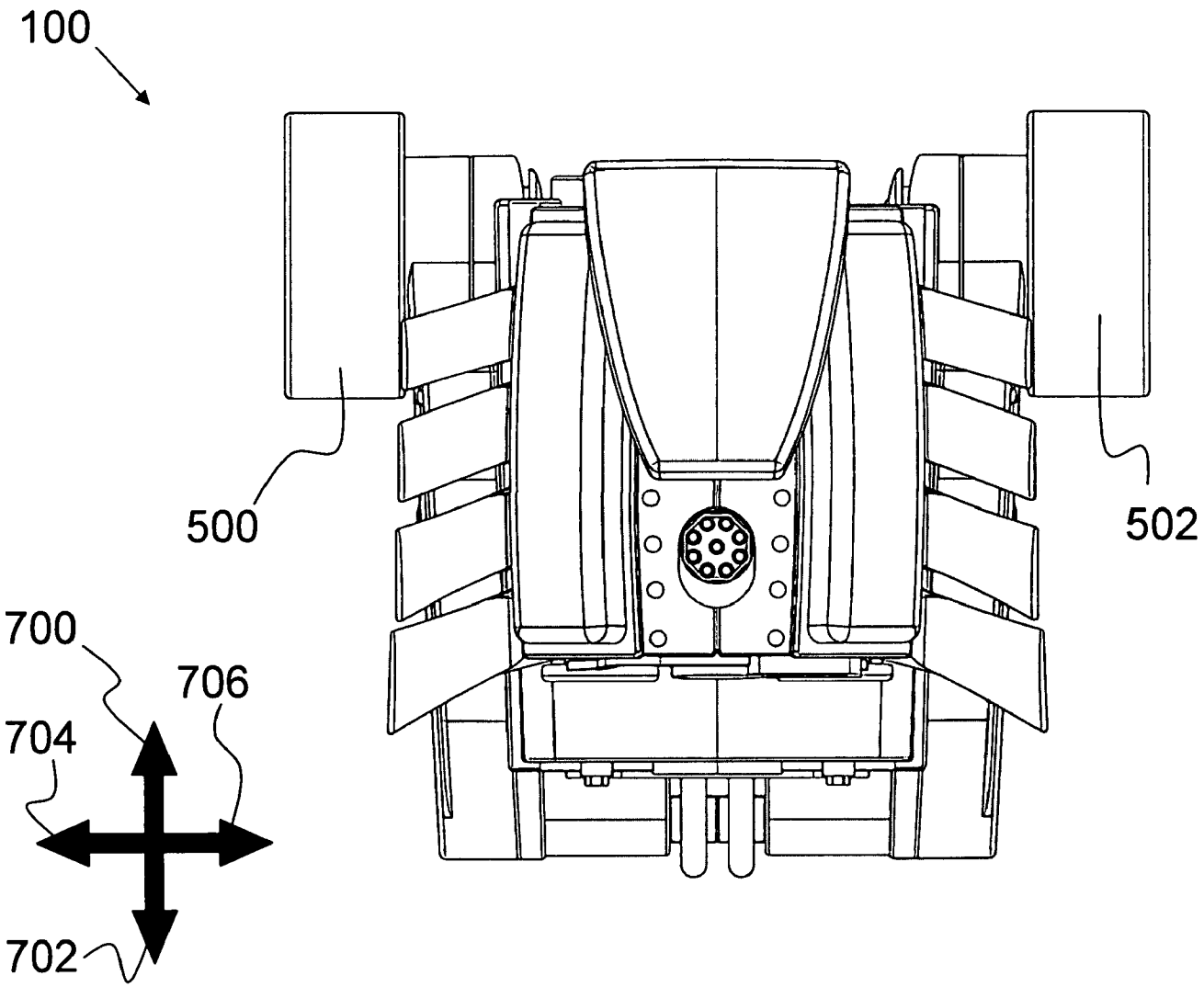
FIG. 7 is a top-view illustration of an adapter according to the present invention.

FIG. 7 is a top-view of the adapter 100. By having two drive wheels, each of which is independently controlled, the adapter 100 is able to effectively turn in a very small radius, such that uni-engagement of the first 500 or second 502 wheels alone causes the adapter 100 to turn, and bi-engagement of both the first 500 and second 502 wheels in opposite directions also causes the adapter 100 to turn. Uni-engagement is when a single motor is powered to rotate only one of the first 500 or second 502 wheels. Alternatively, bi-engagement is when both motors are powered to cause a rotation of both the first 500 and second 502 wheels.

Furthermore, bi-engagement in the same direction (i.e., either forward 700 or reverse 702) causes the adapter 100 to propel itself forward 700 or reverse 702, thereby allowing a user to maneuver the adapter 100 and attached toy vehicle in forward 700, reverse 702, left 704, and right 706 directions.

Figure 8:
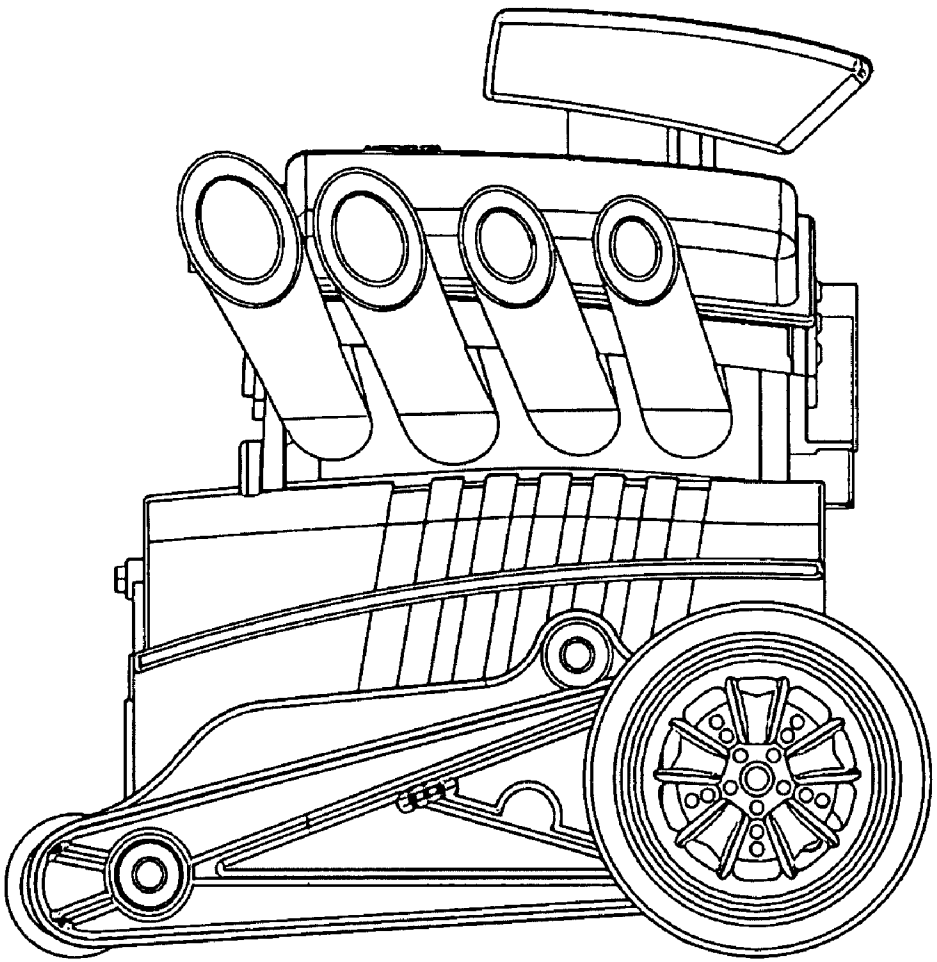
FIG. 8 is a right, side-view illustration of an adapter according to the present invention.
Figure 9:
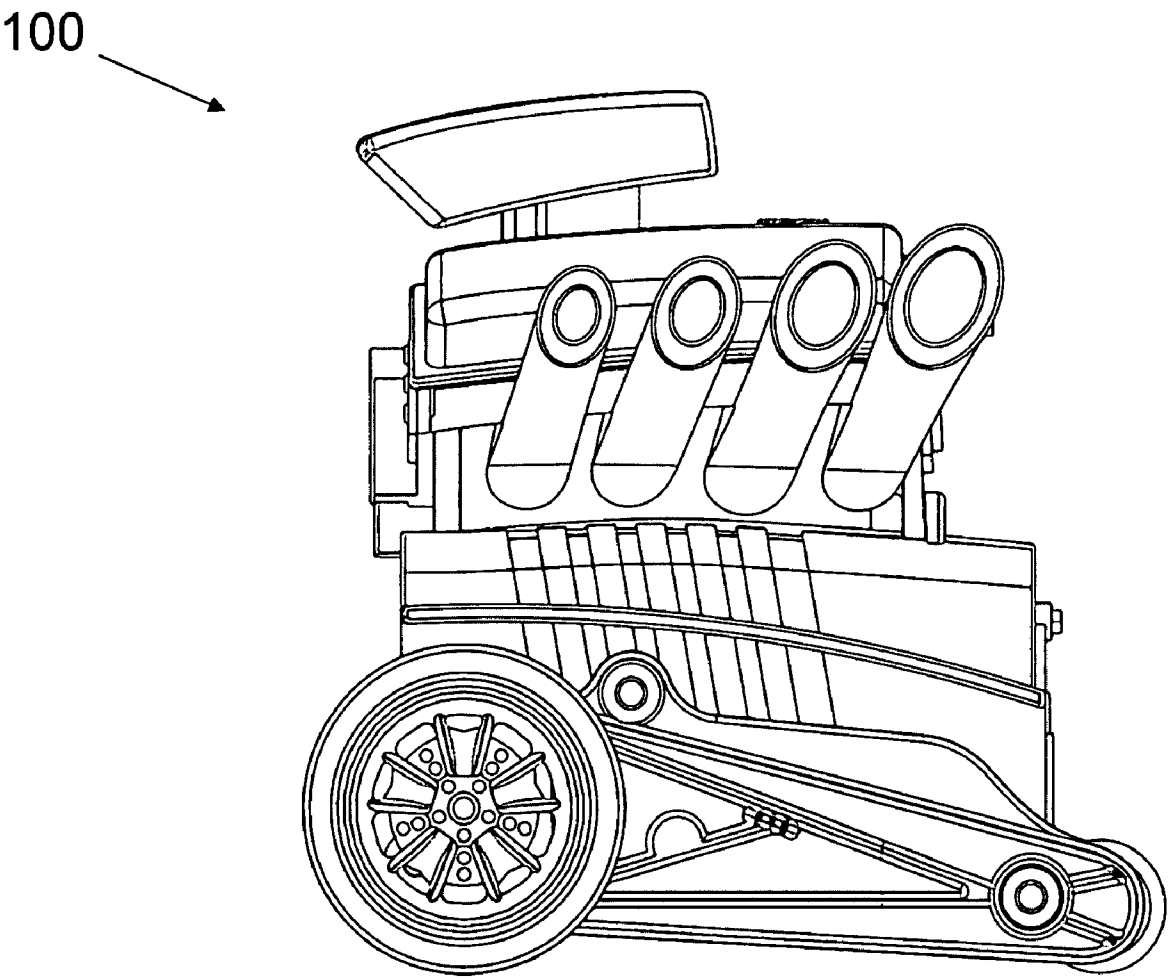
FIG. 9 is a left, side-view illustration of an adapter according to the present invention.
Figure 10:
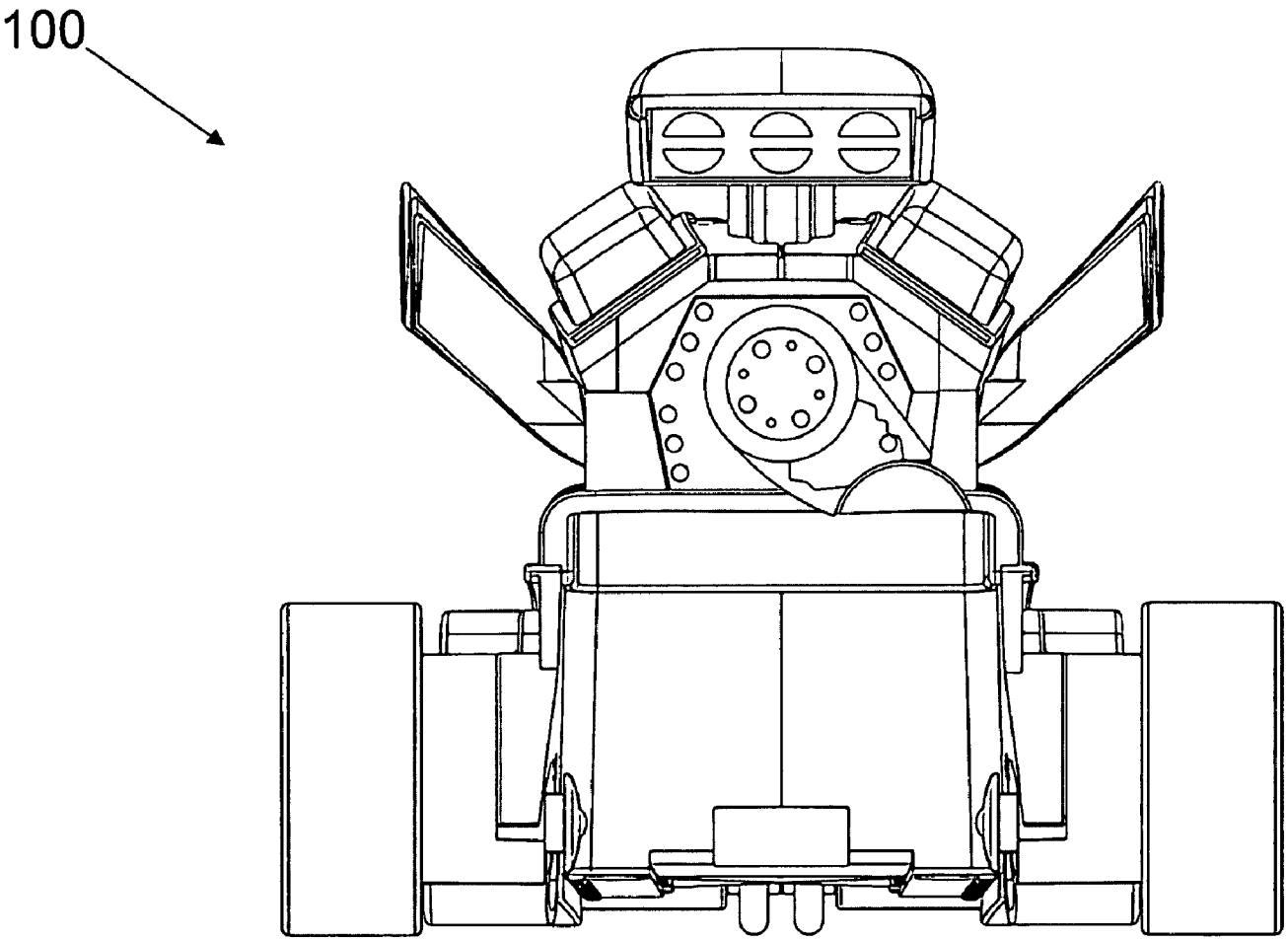
FIG. 10 is a front-view illustration of an adapter according to the present invention.
Figure 11:
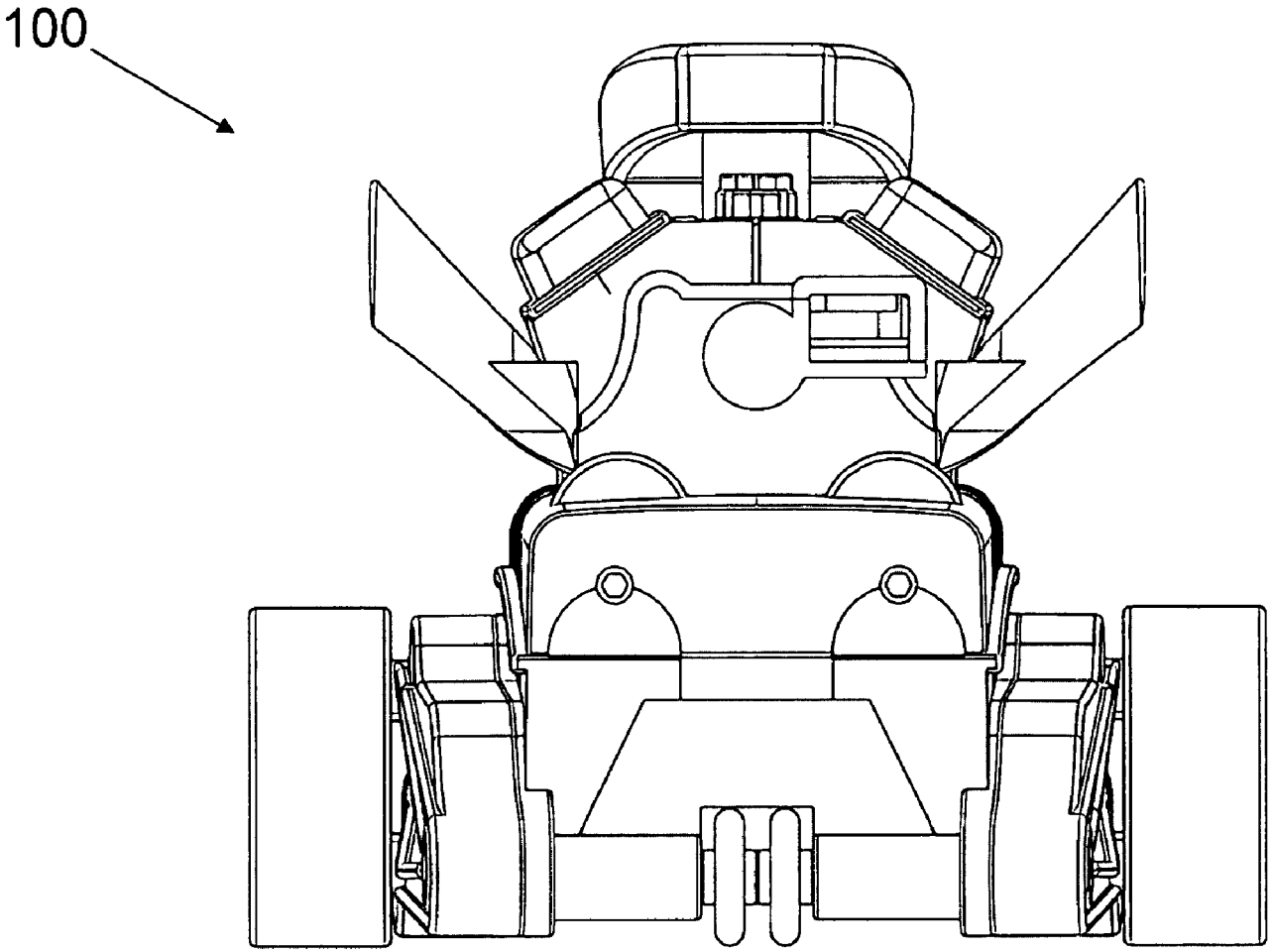
FIG. 11 is a rear-view illustration of an adapter according to the present invention.
Figure 12:
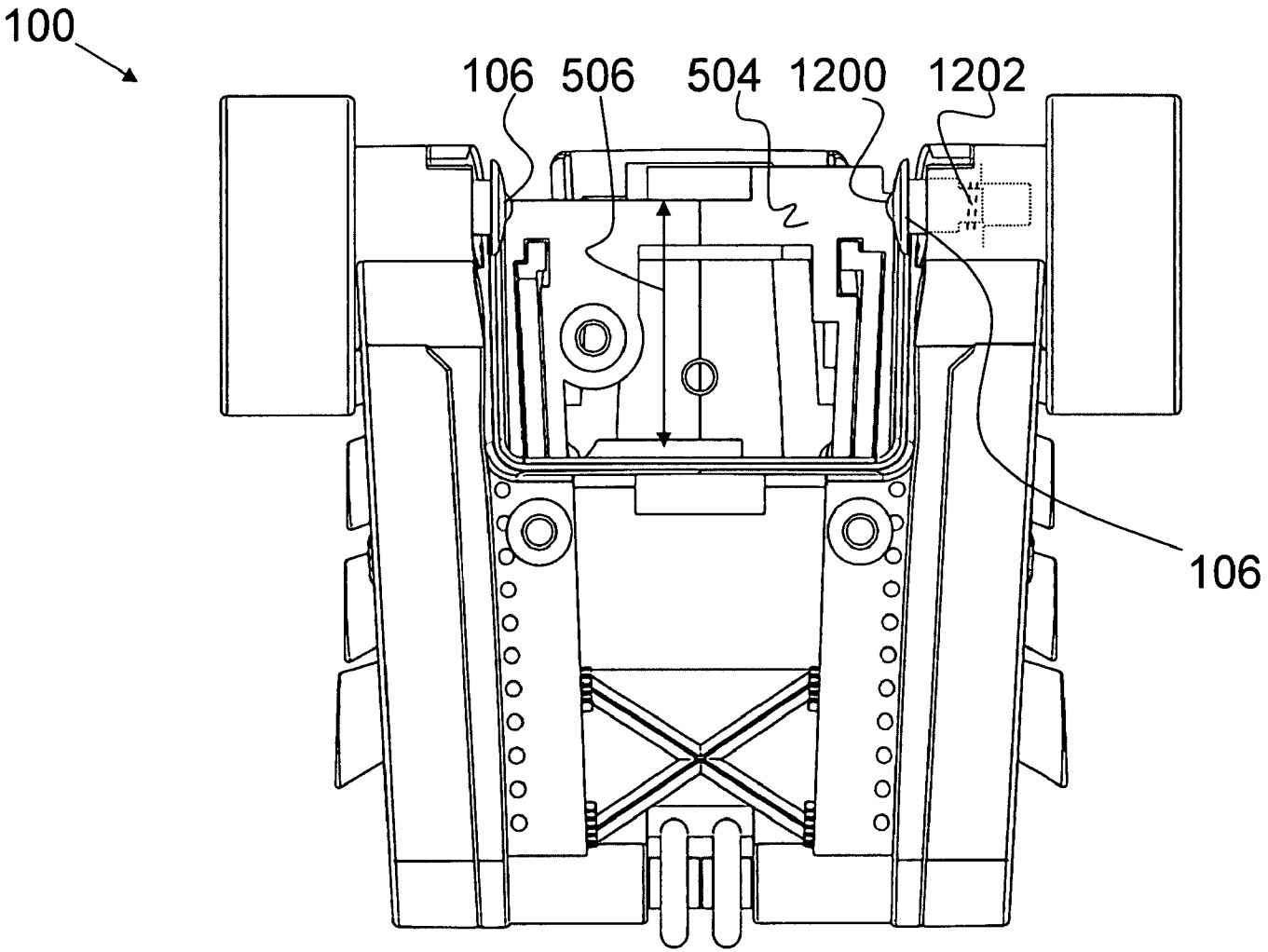
FIG. 12 is a bottom-view illustration of an adapter according to the present invention.

For further clarity, FIGS. 8 through 12 illustrate the adapter 100 from various view points. FIG. 8 is a right side-view illustration of the adapter 100. FIG. 9 is a left side-view illustration of the adapter 100. FIG. 10 is a front-view illustration of the adapter 100. Finally, FIGS. 11 and 12 are rear and bottom-view illustrations of the adapter 100, respectively.

As shown in FIG. 12, the depth 506 of the cavity 504 is sufficient to accommodate a portion (e.g., rear portion) of a toy vehicle. Additionally, the attachment apparatus 106 is formed to affix the toy vehicle with the adapter 100. As described above, the attachment apparatus 106 is any suitable mechanism or device for affixing the toy vehicle with the adapter 100. In one aspect, the attachment apparatus 106 includes at least one spring-loaded pin. The spring-loaded pin includes a pinhead 1200 for engaging with the toy vehicle. Additionally, the spring-loaded pin includes a spring 1202 attached with the pinhead 1200. Expansion/contraction forces of the spring 1206 urge the pinhead 1200 toward an interior of the cavity 504 to compress against a toy vehicle. As can be appreciated by one skilled in the art, multiple, opposing spring-loaded pins can be used such that a toy vehicle can be affixed therebetween.

FIGS. 13A through 13D illustrate the adapter 100 with various components progressively removed to illustrate an interior of the adapter 100.

Figure 13B:
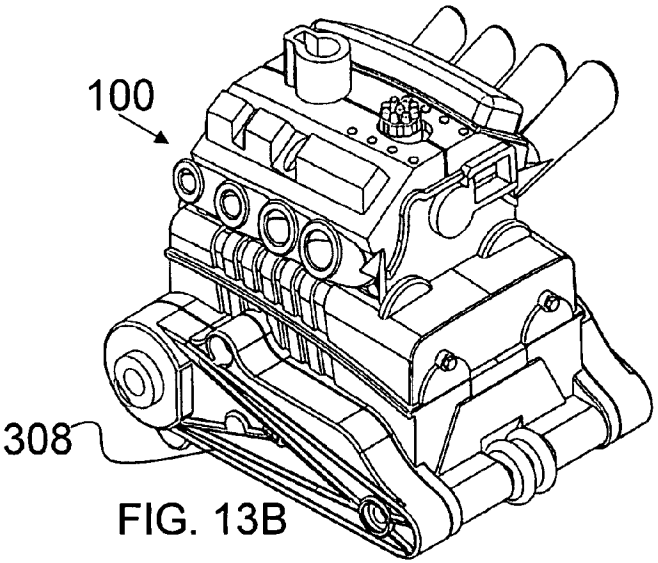
FIG. 13B is a perspective-view illustration of the adapter shown in FIG. 13A, with portions of the adapter removed for illustrative purposes.
Figure 13D:
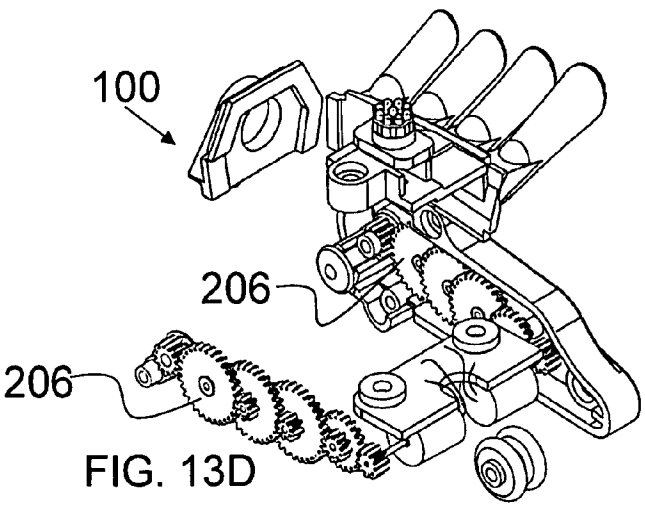
FIG. 13D is a perspective-view illustration of the adapter shown in FIG. 13A, with portions of the adapter removed for illustrative purposes.
Figure 13A:
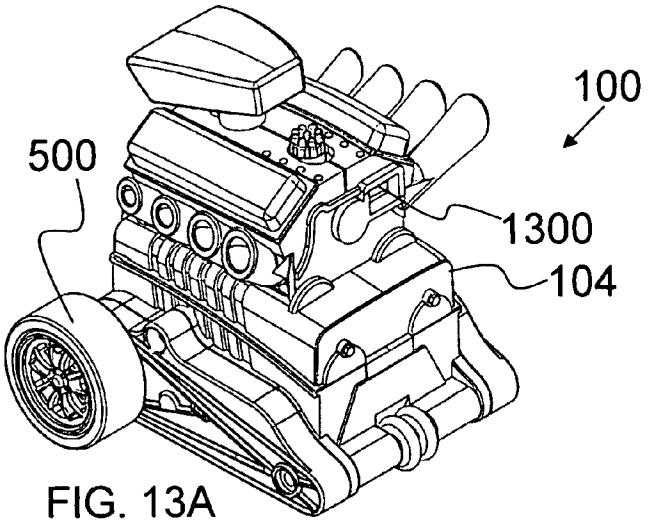
FIG. 13A is a rear, perspective-view illustration of an adapter according to the present invention.

FIG. 13A is a rear perspective-view illustration of the adapter 100. As shown in FIG. 13A, an adapter coupler 1300 is attached with the housing 104 for coupling with a charging mechanism. The adapter coupler 1300 is any suitable mechanism or device for electrically coupling with another device, a non-limiting example of which includes a socket. The adapter coupler 1300 is electrically connected with a power source so that the charging mechanism is capable of detachably attaching with the adapter 100 and charging the adapter power source.

FIG. 13B is an illustration of the adapter 100 with the first wheel removed to illustrate the drive system housing 308.

Figure 13C:
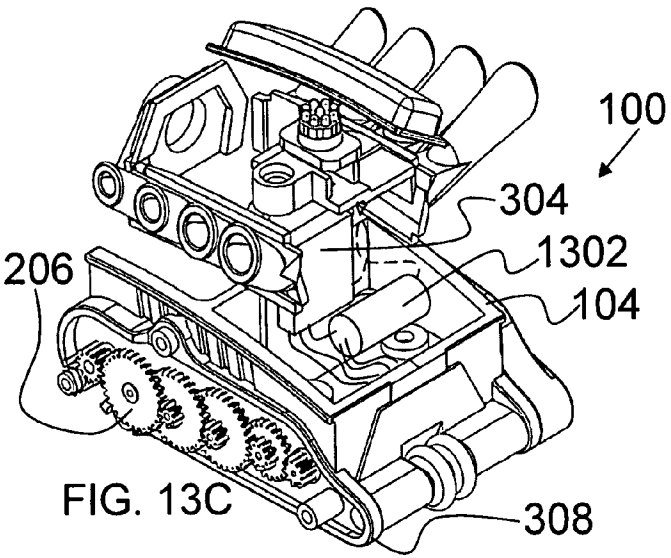
FIG. 13C is a perspective-view illustration of the adapter shown in FIG. 13A, with portions of the adapter removed for illustrative purposes.

FIG. 13C illustrates an interior of both the housing 104 and drive system housing 308. As shown, a drive system 206 is included to transfer torque from the driving apparatus (shown as element 200 in FIG. 13D) to the propelling apparatus (shown as the first wheel 500 in FIG. 13A). Although not limited thereto, the drive system 206 can be a system of interconnected gears. Positioned within the housing 104 is a receiver 304 for receiving signals from the signal transmitter (controller). Additionally, an adapter power source 1302 is included for providing power to the driving apparatus. As briefly discussed above, the adapter power source 1302 is electrically connected with the adapter coupler for receiving a charge from the adapter coupler (which in turns receives power from the charging mechanism). The adapter power source 1302 is any suitable mechanism or device for storing power therein. Due to the size of the adapter 100, it is desirable to have a very small power source that can be quickly charged and recharged. In this capacity, the adapter power source 1302 is a capacitor that is capable of receiving a quick charge through coupling of the coupler to a charging mechanism. Once charged, the capacitor (i.e., adapter power source 1302) is capable of providing power to the driving apparatus.

FIG. 13D is an illustration of the adapter 100, illustrating multiple drive systems 206.

Figure 14:
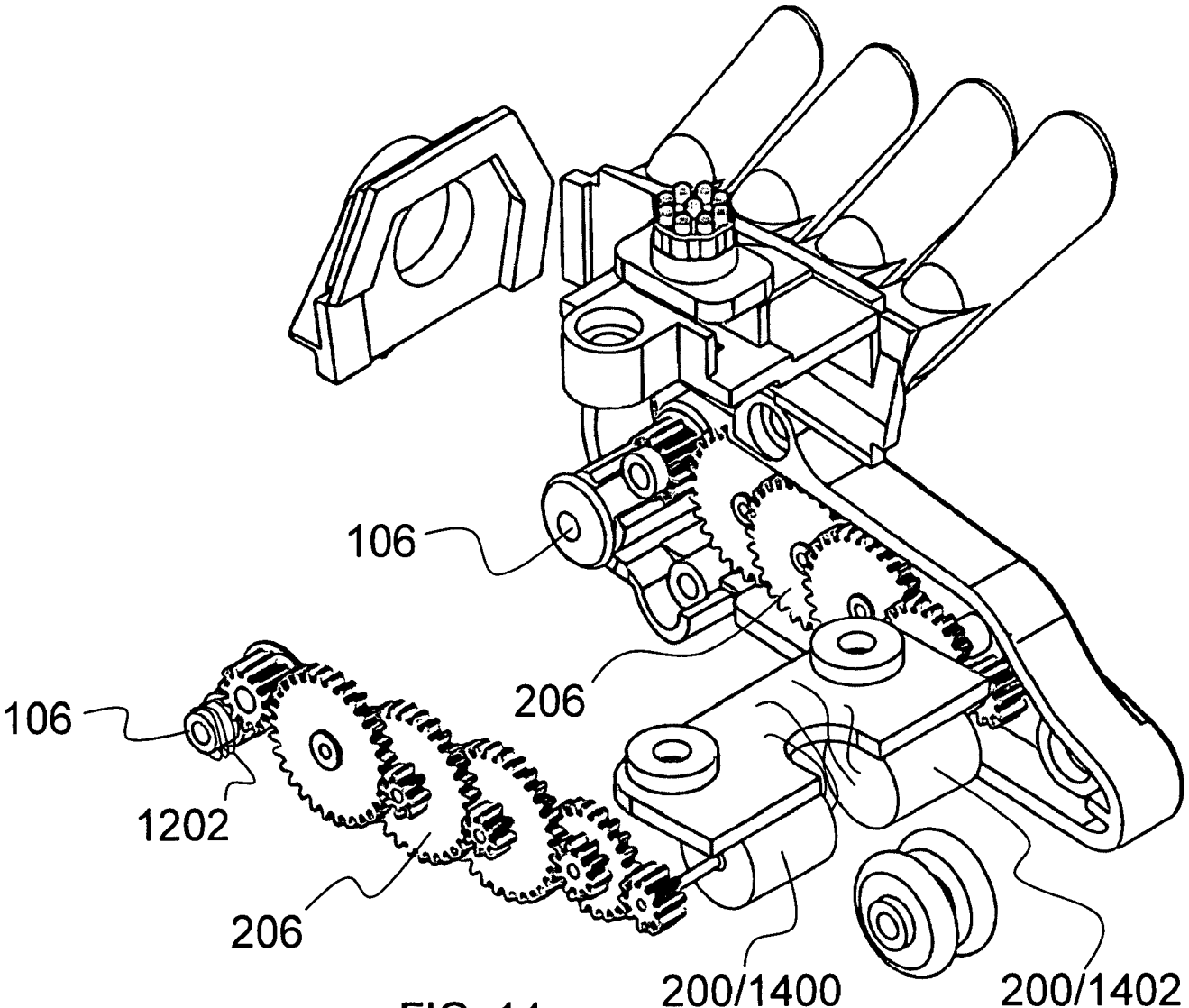
FIG. 14 is a close-up view of the adapter shown in FIG. 13D.

FIG. 14 is a close-up view of the adapter 100 as shown in FIG. 13D. As discussed above, the propelling apparatus includes a first wheel and a second wheel (shown in FIG. 5). In this aspect, the driving apparatus 200 also includes multiple components, such as a first motor 1400 and a second motor 1402. Using a drive system 206 (e.g., gears), the first motor 1400 is drivably coupled with the first wheel while the second motor 1402 is drivably coupled with the second wheel. In addition to being propelled, the use of multiple components also allows the adapter 100 to be steered.

Also shown is the attachment apparatus 106. A spring 1202 is included to provide the necessary forces for operating the spring-loaded pin and force the pinhead 1200 towards a toy vehicle (as described above).

Figure 15:
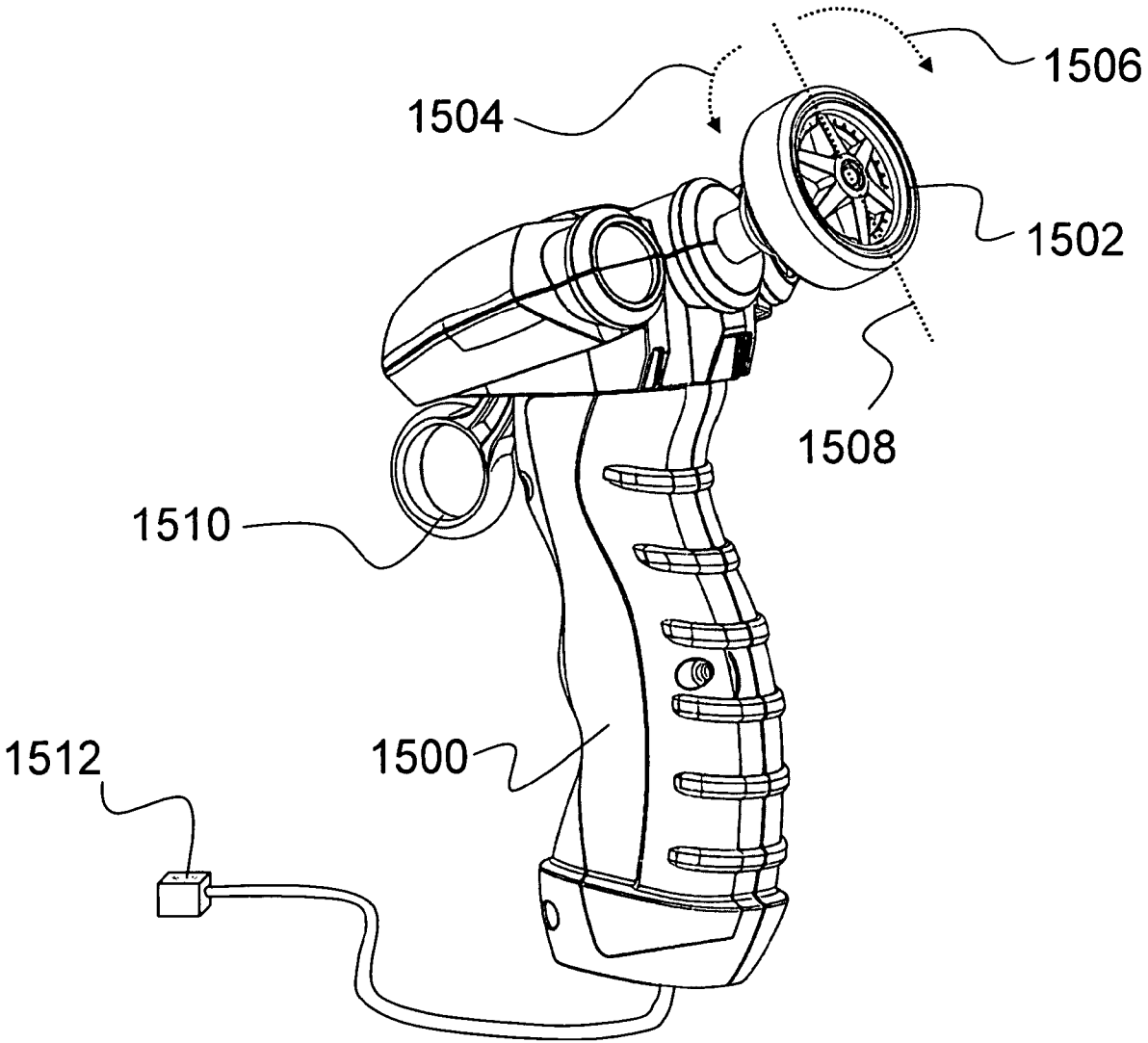
FIG. 15 is a perspective-view illustration of a controller according to the present invention.

FIG. 15 illustrates a controller 1500 according to the present invention. The controller 1500 includes and operates as a signal transmitter to send a control signal to the receiver. The controller 1500 is any suitable mechanism or device for generating driving commands and providing the commands as a control signal to the receiver. For example, the controller 1500 includes a dial 1502 that is used to generate left, straight, and right signals. When the dial 1502 is turned to the left 1504, a signal is transmitted to the adapter 100 to provide more power to the second motor than the first motor and thereby cause the adapter to turn left. Alternatively, when the dial 1502 is turned to the right 1506, a signal is transmitted to the adapter 100 to provide more power to the first motor than the second motor and thereby cause the adapter to turn right. When the dial 1502 is left in a neutral position 1508, an equal amount of power is distributed between each motor so that the adapter 100 can be driven in a straight line.

A trigger 1510 is included and used to generate forward and reverse motions by the motors. For example, when the trigger 1510 is depressed, the adapter 100 is propelled in a forward direction. Alternatively, when the trigger 1510 is extended, the adapter 100 is propelled in a reverse direction. As can be appreciated by one skilled in the art, the directions used herein are for illustrative purposes only as the invention is not intended to be limited thereto.

Finally, the controller 1500 is also used as the charging mechanism for providing power to the adapter coupler. The controller 1500 can be connected with a power outlet or include a controller power source therein. Using a controller coupler 1512, power is transferred from the controller 1500 (and its controller power source) and through the adapter coupler to be stored in the adapter power source.

In a desired aspect, the controller 1500 includes a battery. Using the controller coupler 1512 and the adapter coupler, power from the battery can be quickly transferred to and stored in the adapter's power source.

Thus, by attaching the adapter with a non-motorized toy vehicle, a user can convert the toy vehicle into a remotely-controlled toy vehicle.

What is claimed is:

1. An adapter for motorizing a non-motorized toy vehicle, comprising:

a housing;

an attachment apparatus connected with the housing, the housing and attachment apparatus being formed to attach with a toy vehicle;

a driving apparatus connected with the housing, the driving apparatus being capable of providing a driving force to a propelling apparatus; and a propelling apparatus drivably connected with the driving apparatus, whereby when connected with a toy vehicle, the driving apparatus may be activated to engage with the propelling apparatus, thereby causing the propelling apparatus to force the adapter and the attached toy vehicle across a surface.

2. An adapter as set forth in claim 1, further comprising a receiver connected with the housing, where the receiver is electrically connected with the driving apparatus and is configured to receive a wireless signal from a signal transmitter, whereby attaching the adapter with a non-motorized toy vehicle converts the toy vehicle into a wirelessly controlled toy vehicle.

3. An adapter as set forth in claim 2, wherein the housing and attachment apparatus are formed to detachably attach with the toy vehicle.

4. An adapter as set forth in claim 3, wherein the housing is formed to include a cavity, the cavity being formed to accommodate at least a portion of a toy vehicle therein.

5. An adapter as set forth in claim 4, wherein the cavity is formed to accommodate a portion of a toy vehicle that is a 1:64 scale die-cast toy vehicle.

6. An adapter as set forth in claim 5, wherein the driving apparatus comprises a first motor and a second motor, and wherein the propelling apparatus comprises a first wheel and a second wheel, such that the first motor is drivably coupled with the first wheel and the second motor is drivably coupled with the second wheel.

7. An adapter as set forth in claim 6, wherein the receiver is connected with both the first and second motors such that a control signal from a signal transmitter provides for independent control of each of the first and second motors and thereby allows for independent control of the first and second wheels.

8. An adapter as set forth in claim 7, further comprising a drive system connecting the driving apparatus with the propelling apparatus to drive the propelling apparatus.

9. An adapter as set forth in claim 8, wherein the attachment apparatus comprises a pair of spring-loaded pins, each of which is positioned within the cavity to allow for attachment of the toy vehicle therebetween.

10. An adapter as set forth in claim 9, further comprising an adapter power source for powering the driving apparatus, and wherein the adapter power source is a capacitor.

11. An adapter as set forth in claim 10, further comprising an adapter coupler attached with the housing, the adapter coupler being electrically connected with the adapter power source and being formed to detachably attach with a charging mechanism.

12. An adapter as set forth in claim 2, further comprising a drive system connecting the driving apparatus with the propelling apparatus to drive the propelling apparatus, wherein:

the propelling apparatus is a wheel, such that when the adapter is attached with a toy vehicle, the wheel propels the toy vehicle across a surface;

the attachment apparatus is a clip and further comprising a spring mechanism attached with the clip, such that the clip can be opened to accommodate and attach with toy vehicles of varying sizes; and a turning motor is connected with the housing, where the turning motor is configured to turn the wheel, whereby a user may steer the adapter when in motion by using a transmitter to turn the wheel.

13. An adapter as set forth in claim 1, further comprising a receiver connected with the housing, where the receiver is electrically connected with the driving apparatus and is configured to receive a wireless signal from a signal transmitter, wherein:

the housing is formed to include a cavity, the cavity being formed to accommodate at least a portion of a 1:64 scale die-cast toy vehicle therein and detachably attach with the toy vehicle;

the driving apparatus comprises a first motor and a second motor, and wherein the propelling apparatus comprises a first wheel and a second wheel, such that the first motor is drivably coupled with the first wheel and the second motor is drivably coupled with the second wheel;

the receiver is connected with both the first and second motors such that a control signal from a signal transmitter provides for independent control of each of the first and second motors and thereby allows for independent control of the first and second wheels;

a drive system connects the driving apparatus with the propelling apparatus to drive the propelling apparatus;

the attachment apparatus comprises a pair of spring-loaded pins, each of which is positioned within the cavity to allow for attachment of the toy vehicle therebetween;

an adapter power source is included for powering the driving apparatus, and wherein the adapter power source is a capacitor;

an adapter coupler is attached with the housing, the adapter coupler being electrically connected with the adapter power source and being formed to detachably attach with a charging mechanism; and a controller is included that has a signal transmitter for transmitting a signal to the receiver, the controller further comprising a controller coupler that is formed to electrically connect with the adapter coupler, such that when connected, the controller power source is electrically connected with the adapter power source, thereby providing for charging of the adapter power source, whereby attaching the adapter with a non-motorized toy vehicle converts the toy vehicle into a wirelessly controlled toy vehicle.

14. An adapter as set forth in claim 1, wherein the housing is formed to include a cavity, the cavity being formed to accommodate at least a portion of a toy vehicle therein.

15. An adapter as set forth in claim 14, wherein the cavity is formed to accommodate a portion of a toy vehicle that is a 1:64 scale die-cast toy vehicle.

16. An adapter as set forth in claim 15, wherein the attachment apparatus comprises a pair of spring-loaded pins, each of which is positioned within the cavity to allow for attachment of the toy vehicle therebetween.

17. An adapter as set forth in claim 1, wherein the driving apparatus comprises a first motor and a second motor, and wherein the propelling apparatus comprises a first wheel and a second wheel, such that the first motor is drivably coupled with the first wheel and the second motor is drivably coupled with the second wheel.

18. An adapter as set forth in claim 17, wherein the receiver is connected with both the first and second motors such that a control signal from a signal transmitter provides for independent control of each of the first and second motors and thereby allows for independent control of the first and second wheels.

19. An adapter as set forth in claim 1, further comprising a drive system connecting the driving apparatus with the propelling apparatus to drive the propelling apparatus.

20. An adapter as set forth in claim 1, further comprising an adapter power source for powering the driving apparatus, and wherein the adapter power source is a capacitor.

21. An adapter as set forth in claim 20, further comprising an adapter coupler attached with the housing, the adapter coupler being electrically connected with the adapter power source and being formed to detachably attach with a charging mechanism.

22. An adapter as set forth in claim 21, further comprising a controller having a signal transmitter for transmitting a signal to the receiver, the controller further comprising a controller coupler that is formed to electrically connect with the adapter coupler, such that when connected, the controller power source is electrically connected with the adapter power source, thereby providing for charging of the adapter power source.

23. An adapter as set forth in claim 1, wherein the housing and attachment apparatus are formed to detachably attach with the toy vehicle.

* * * * *